US008161926B2

(12) United States Patent
Mashiki et al.

(10) Patent No.: US 8,161,926 B2
(45) Date of Patent: Apr. 24, 2012

(54) DEVICE AND METHOD FOR CONTROLLING INTERNAL COMBUSTION ENGINE

(75) Inventors: Zenichiro Mashiki, Aichi-ken (JP); Yasumichi Inoue, Aichi-ken (JP); Yoshihito Moriya, Aichi-ken (JP); Haruyuki Urushihata, Aichi-ken (JP)

(73) Assignees: Toyota Jidosha Kabushiki Kaisha, Aichi-Ken (JP); Denso Corporation, Aichi-Ken (JP)

( * ) Notice: Subject to any disclaimer, the term of this patent is extended or adjusted under 35 U.S.C. 154(b) by 193 days.

(21) Appl. No.: 12/693,153

(22) Filed: Jan. 25, 2010

(65) Prior Publication Data

US 2010/0126451 A1 May 27, 2010

Related U.S. Application Data

(63) Continuation of application No. 11/654,614, filed on Jan. 18, 2007, now Pat. No. 7,690,340.

(30) Foreign Application Priority Data

Jan. 20, 2006 (JP) ..... 2006-012246

(51) Int. Cl.
*F01L 1/34* (2006.01)

(52) U.S. Cl. ..... 123/90.17; 123/347

(58) Field of Classification Search .... 123/90.15–90.18, 123/321, 322, 345–348
See application file for complete search history.

(56) References Cited

U.S. PATENT DOCUMENTS

| | | | | |
|---|---|---|---|---|
| 7,520,255 | B2 * | 4/2009 | Shimojo et al. | 123/90.17 |
| 7,690,340 | B2 * | 4/2010 | Mashiki et al. | 123/90.17 |
| 2007/0175427 | A1 * | 8/2007 | Inoue et al. | 123/90.17 |
| 2008/0017149 | A1 * | 1/2008 | Kokubo et al. | 123/90.16 |
| 2009/0265077 | A1 * | 10/2009 | Urushihata | 701/103 |
| 2010/0131180 | A1 * | 5/2010 | Hattori et al. | 701/105 |
| 2010/0242880 | A1 * | 9/2010 | Watanabe et al. | 123/90.17 |

FOREIGN PATENT DOCUMENTS

| | | | |
|---|---|---|---|
| JP | 4-1406 | A | 1/1992 |
| JP | 5-33680 | A | 2/1993 |
| JP | 2002-138864 | A | 5/2002 |
| JP | 2003-172160 | A | 6/2003 |
| JP | 2004-116301 | A | 4/2004 |
| JP | 2004-340013 | A | 12/2004 |
| JP | 2005-16485 | A | 1/2005 |

* cited by examiner

*Primary Examiner* — John Kwon
(74) *Attorney, Agent, or Firm* — Sughrue Mion, PLLC

(57) ABSTRACT

If it is necessary to rapidly change a phase of an intake camshaft and an intake VVT mechanism relatively slow in responsiveness as it is associated with an "A" bank of a V-type, 8-cylinder engine is in operation for at least a predetermined period of time, an ECU executes a program including the step of controlling intake VVT mechanisms to operate those associated with both the "A" bank and a "B" bank.

9 Claims, 3 Drawing Sheets

DEVICE AND METHOD FOR CONTROLLING INTERNAL COMBUSTION ENGINE

CROSS-REFERENCE TO RELATED APPLICATION

This is a Continuation of U.S. application Ser. No. 11/654,614 filed Jan. 18, 2007, now issued as U.S. Pat. No. 7,690,340, which claims priority from Japanese Patent Application No. 2006-012246 filed with the Japan Patent Office on Jan. 20, 2006, the entire contents of the prior applications are hereby incorporated by reference.

BACKGROUND OF THE INVENTION

1. Field of the Invention

The present invention relates to devices and methods for controlling internal combustion engines and particularly to controlling internal combustion engines having a plurality of variable valve timing (VVT) mechanisms changing a phase in which at least one of intake and exhaust valves is opened/closed.

2. Description of the Background Art

VVT (Variable Valve Timing) has conventionally been known that changes a phase (crank angle) in which an intake valve or an exhaust valve is opened/closed, according to an operating condition. Generally, the VVT changes the phase by rotating a camshaft that causes the intake valve or exhaust valve to open/close. For example for a V-type engine a camshaft is provided for each bank or group of cylinders. Such an engine can be designed to cause only the camshaft associated with one cylinder group (or bank) alone to drive a fuel pump (a high pressure pump supplying fuel to an injector for injecting the fuel directly into a cylinder, in particular), a vacuum pump and other auxiliaries. In that case, the camshaft associated with one cylinder group is different from that associated with another cylinder group in rotational resistance and hence responsiveness to variation of the phase. As such, similarly (or concurrently) operating the VVTs associated with the camshafts, respectively, may not necessarily similarly (or concurrently) vary phases in which the intake and exhaust valves are opened/closed. In that case, one cylinder group receives an amount of air, while the other cylinder group receives a different amount of air. This disadvantageously facilitates the engine to rotate variably (in speed while the crankshaft rotates once) and significantly vibrate. Accordingly the responsiveness to variation of the phase must be considered in operating the VVT.

Japanese Patent Laying-Open No. 2003-172160 discloses a variable valve timing control device for an internal combustion engine that allows a plurality of cylinder groups to match in responsiveness of valve timing control if their camshafts are unbalanced in load torque by a load of auxiliaries. As disclosed in Japanese Patent Laying-Open No. 2003-172160, the variable valve timing control device for an internal combustion engine includes: intake and exhaust camshafts provided for each of a plurality of groups of cylinders of an internal combustion engine; a valve timing adjustment unit advancing or retarding the phase of the rotation of at least one of the intake and exhaust camshafts of each cylinder group relative to that of the rotation of the crankshaft to time at least one of intake and exhaust valves of each cylinder group to operate earlier or later; a control unit exerting valve timing control to control the valve timing adjustment unit of each cylinder group in controllability to match each cylinder group's actual valve timing to its targeted valve timing; auxiliaries driven by a camshaft of a particular cylinder group; and a correction unit reflecting the particular cylinder group's delay in responsiveness of valve timing control that is attributed to a load of the auxiliaries in correcting in controllability the valve timing adjustment unit(s) of the particular cylinder group and/or another cylinder group to match the particular cylinder group to another cylinder group in responsiveness of valve timing control.

As disclosed in the publication, the variable valve timing control device for an internal combustion engine allows a correction unit to allow a plurality of cylinder groups to match in responsiveness of valve timing control if the camshafts of the plurality of cylinder groups, respectively, are unbalanced in load torque by a load of auxiliaries.

However, if the valve timing adjustment unit is corrected in controllability to allow a cylinder group for which valve timing control responds with a delay and another cylinder group to match in responsiveness of valve timing control, as described in Japanese Patent Laying-Open No. 2003-172160, the plurality of cylinder groups nevertheless can have their valves differently timed to differently open/close. For example, if a camshaft is rotated by an electrically operated actuator (e.g., a motor or the like), the actuator requires a large current, since rotating the camshaft requires a large torque. In that case, concurrently operating electrically operated actuators associated with the cylinder groups, respectively, can result in an excessively increased load on an electric circuit energizing the actuators. This can result in the actuators receiving an insufficient current. As such, a cylinder group providing a response delayed by a load torque of the camshaft cannot be improved to be sufficiently fast in responsiveness and consequently cannot achieve responsiveness as requested. As a result the plurality of cylinder groups can have their valves differently timed to differently open/close.

SUMMARY OF THE INVENTION

The present invention contemplates a control device or the like for an internal combustion engine that can help intake and exhaust valves and the like to match in being timed to open/close.

The present invention in one aspect provides a control device controlling an internal combustion engine provided with a plurality of mechanisms changing a phase in which at least one of an intake valve and an exhaust valve opens/closes. The control device includes an operation unit controlling a first one of the plurality of mechanisms and controlling a second one of the plurality of mechanisms to start to operate later by a predetermined period of time than the first mechanism.

In accordance with the present invention the second mechanism is controlled to start to operate later by a predetermined period of time than the first mechanism. The first and second mechanisms can thus be timed differently to differently start to operate. If the mechanisms are electrically operated, they can be energized at different times to operate, and thus receive sufficient power. A control device for an internal combustion engine can thus be provided that can reduce or prevent a delay otherwise introduced into the operation of the mechanism and thus help the intake and exhaust valves and the like to match in being timed to open/close.

Preferably the first mechanism is slower than another one of the plurality of mechanisms in responding to that the phase is changed.

In accordance with the present invention the second mechanism is controlled to start to operate later by the predetermined period of time than the first mechanism slow in responsiveness to that the phase is changed. This can reduce or prevent variation among the mechanisms in when the phase attains the target value, and help the intake and exhaust valves and the like to match in being timed to open/close.

More preferably, the operation unit further determines whether the phase is changed faster than predetermined, and if the phase is changed faster than predetermined, the operation unit controls the second mechanism to start to operate later by the predetermined period of time than the first mechanism.

In accordance with the present invention, if the phase is changed faster than predetermined, the second mechanism is controlled to start to operate later by the predetermined period of time than the first mechanism, since if the phase is changed faster, a mismatch in timing the intake and exhaust valves to open and close that is attributed to a difference in responsiveness to that the phase is changed, becomes more remarkable. The plurality of mechanisms can thus be differently timed to differently start to operate. If the mechanisms are electrically operated, they can be energized at different times to operate, and thus receive sufficient power. This can reduce or prevent a delay otherwise introduced into the operation of the mechanism and help the intake and exhaust valves and the like to match in being timed to open/close.

More preferably the operation unit determines that the phase is changed faster than predetermined if the phase is changed by an amount larger than predetermined.

In accordance with the present invention a decision that the phase is changed faster than predetermined is made if the phase is changed by an amount larger than predetermined. Accordingly the first and second mechanisms can be differently timed to differently start to operate if the phase is changed by the amount larger than predetermined and it is necessary to rapidly change the phase. If the mechanisms are electrically operated, they can be energized at different times to operate, and thus receive sufficient power. This can reduce or prevent a delay otherwise introduced into the operation of the mechanism and help the intake and exhaust valves and the like to match in being timed to open/close.

Still preferably the operation unit controls the first mechanism to maximally retard the phase, and controls the second mechanism to start to operate later by the predetermined period of time than the first mechanism, and, in addition, to maximally retard the phase.

In accordance with the present invention if the phase is maximally retarded the second mechanism is controlled to start to operate later by the predetermined period of time than the first mechanism. This allows the first and second mechanisms to be differently timed to differently start to operate for example in detecting (or learning) a maximally retarded position of the intake and exhaust valves. If the mechanisms are electrically operated, they can be energized at different times to operate. This can alleviate a load on an electric circuit energizing the mechanism.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
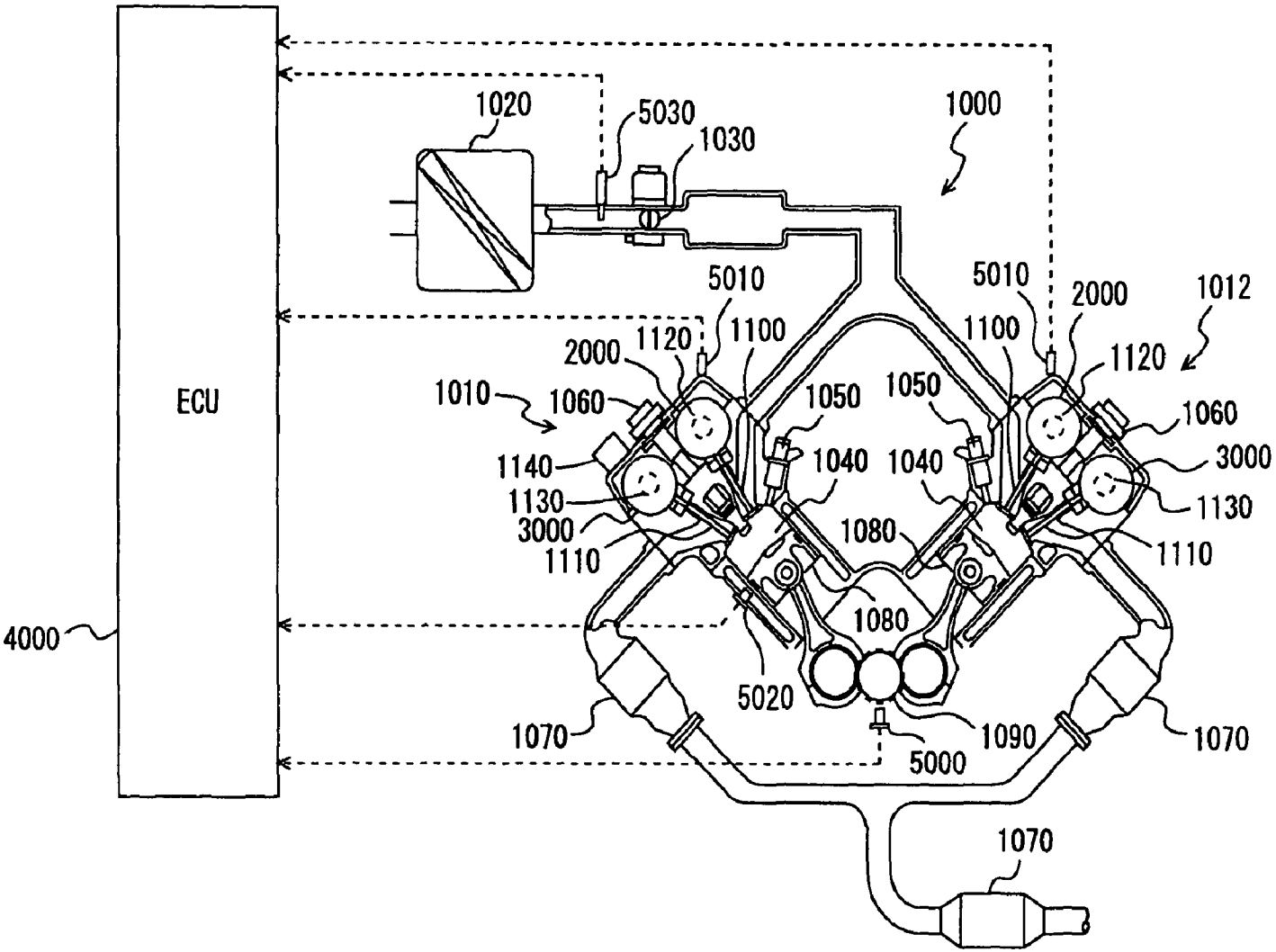
FIG. 1 schematically shows a configuration of an engine of a vehicle with an ECU mounted therein to serve as a control device of an embodiment of the present invention.

With reference to the drawings, an embodiment of the present invention will be described hereinafter. In the following description, like components are denoted by like reference characters. They are also named identically and function identically. Therefore, a detailed description thereof will not be repeated.

Referring to FIG. 1, a description is given of an engine of a vehicle having a control device mounted therein according to the embodiment of the present invention. In the present embodiment the control device is implemented by a program executed for example by an electronic control unit (ECU) 4000 shown in FIG. 1.

An engine 1000 is a V-type, 8-cylinder engine having an "A" bank 1010 and a "B" bank 1012 each including a group of four cylinders. Here, any engine other than the V8 engine may be employed.

Into engine 1000, air is sucked from an air cleaner 1020. The quantity of air sucked is adjusted by a throttle valve 1030. Throttle valve 1030 is an electronic throttle valve driven by a motor.

The air is mixed with fuel in a cylinder 1040 (or combustion chamber). Into cylinder 1040, the fuel is directly injected from an injector 1050. In other words, injection holes of injector 1050 are provided within cylinder 1040.

The fuel is injected in the intake stroke. When the fuel is injected is not limited to the intake stroke. Further, in the present embodiment, engine 1000 is described as a direct-injection engine having injection holes of injector 1050 that are disposed within cylinder 1040. However, in addition to direct-injection (in-cylinder) injector 1050, a port injector may be provided. Moreover, only the port injector may be provided.

The air-fuel mixture in cylinder 1040 is ignited by a spark plug 1060 and accordingly burned. The air-fuel mixture after burned, namely exhaust gas, is cleaned by a three-way catalyst 1070 and thereafter discharged to the outside of the vehicle. The air-fuel mixture is burned to press down a piston 1080 and thereby rotate a crankshaft 1090.

At the top of cylinder 1040, an intake valve 1100 and an exhaust valve 1110 are provided. Intake valve 1100 is driven by an intake camshaft 1120. Exhaust valve 1110 is driven by an exhaust camshaft 1130. Intake camshaft 1120 and exhaust camshaft 1130 are coupled by a chain, a gear and/or the like to be rotated at the same rotational speed.

Intake valve 1100 has its phase (or is timed to open/close, as) controlled by an intake VVT mechanism 2000 provided to intake camshaft 1120. Exhaust valve 1110 has its phase (or is timed to open/close, as) controlled by an exhaust VVT mechanism 3000 provided to exhaust camshaft 1130.

In the present embodiment, intake camshaft 1120 and exhaust camshaft 1130 are rotated by the VVT mechanisms to time intake valve 1100 and exhaust valve 1110, as controlled, to open/close. Note that the valves may be timed, as controlled in a method different than above, to open/close.

Intake VVT mechanism 2000 is operated by an electric motor. Exhaust VVT mechanism 3000 is hydraulically operated. Here, intake VVT mechanism 2000 may be hydraulically operated while exhaust VVT mechanism 3000 may be operated by an electric motor. Furthermore the VVT mechanism can be implemented by known technology and accordingly, will not be described herein in detail.

To ECU 4000, signals indicating the rotational speed and the crank angle of crankshaft 1090 are input from a crank angle sensor 5000. Further, to ECU 4000, signals indicating respective phases of intake camshaft 1120 and exhaust camshaft 1130 (phase: the camshaft position in the rotational direction) are input from a cam position sensor 5010.

Furthermore, to ECU 4000, a signal indicating the water temperature (coolant temperature) of engine 1000 from a coolant temperature sensor 5020 as well as a signal indicating the quantity of intake air (quantity of air taken or sucked into engine 1000) of engine 1000 from an airflow meter 5030 are input.

Based on these signals input from the sensors as well as a map and a program stored in a memory (not shown), ECU 4000 controls: the throttle angle; the timing of ignition; the timing of injection of fuel; the quantity of fuel injected; timing intake and exhaust valves 1100 and 1110 to open/close; and the like so that engine 1000 is operated in a desired operating state.

Figure 2:
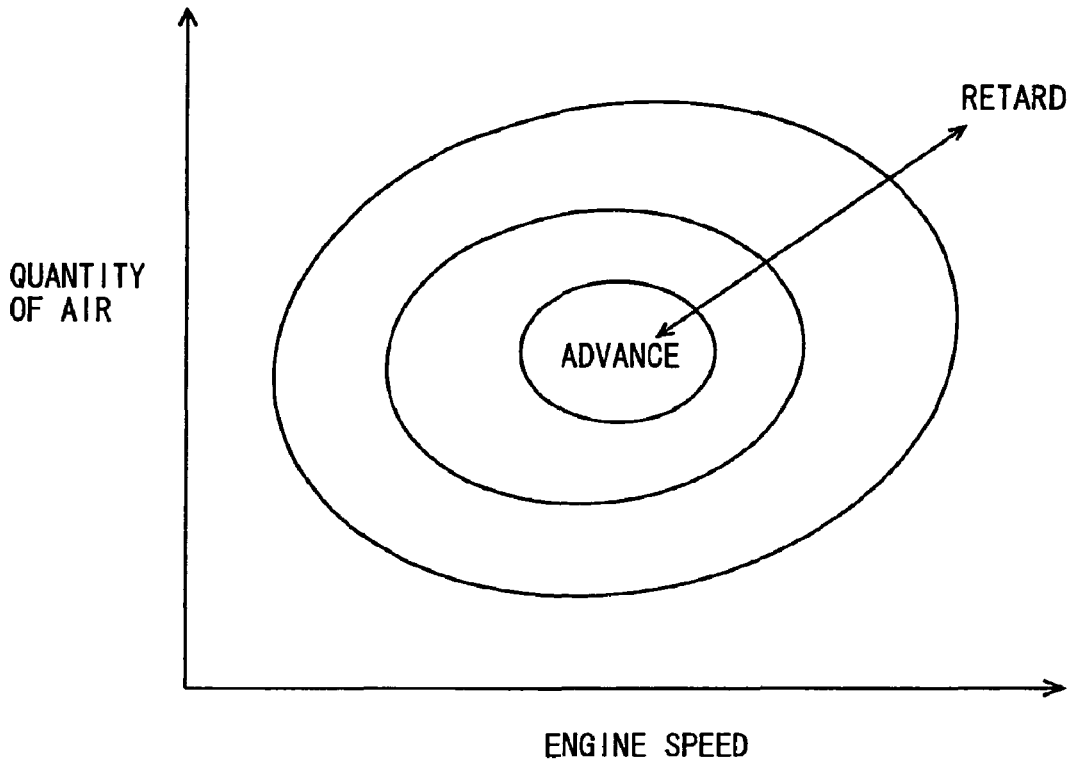
FIG. 2 shows a map defining a target value of the phase of an intake camshaft.

In the present embodiment, ECU 4000 determines the phase of intake camshaft 1120 (or how intake valve 1100 should be timed to open/close) based on the map as shown in FIG. 2 that uses the engine speed NE and the intake air quantity KL as parameters. A plurality of maps for respective coolant temperatures are stored for determining the phase of intake camshaft 1120.

Referring back to FIG. 1, of "A" bank 1010 and "B" bank 1012, "A" bank 1010 is provided with a high pressure pump 1140 pressurizing a fuel fed to injector 1050.

High pressure pump 1140 is driven by exhaust camshaft 1130 of "A" bank 1010. A cam provided at exhaust camshaft 1130 of "A" bank 1010 moves a pump plunger of high pressure pump 1140 upwards and downwards to pressurize the fuel. Alternatively, intake camshaft 1120 may drive high pressure pump 1140.

Intake and exhaust camshafts 1120 and 1130 are connected by a chain, a gear, and/or the like. Accordingly, whichever camshaft may drive high pressure pump 1140, the torque required to rotate intake and exhaust camshafts 1120 and 1130 increases by that driving high pressure pump 1140.

As such, the responsiveness in the case where intake and exhaust camshafts 1120 and 1130 of "A" bank 1010 are rotated by the VVT mechanism is lower than that in the case where intake and exhaust camshafts 1120 and 1130 of "B" bank 1012 are rotated by the VVT mechanism.

Note that intake and exhaust camshafts 1120 and 1130 may not be connected together and instead adapted to rotate independently. Furthermore, high pressure pump 1140 may be provided at "B" bank 1012. Furthermore, high pressure pump 1140 may be replaced with a vacuum pump or other auxiliaries.

Figure 3:
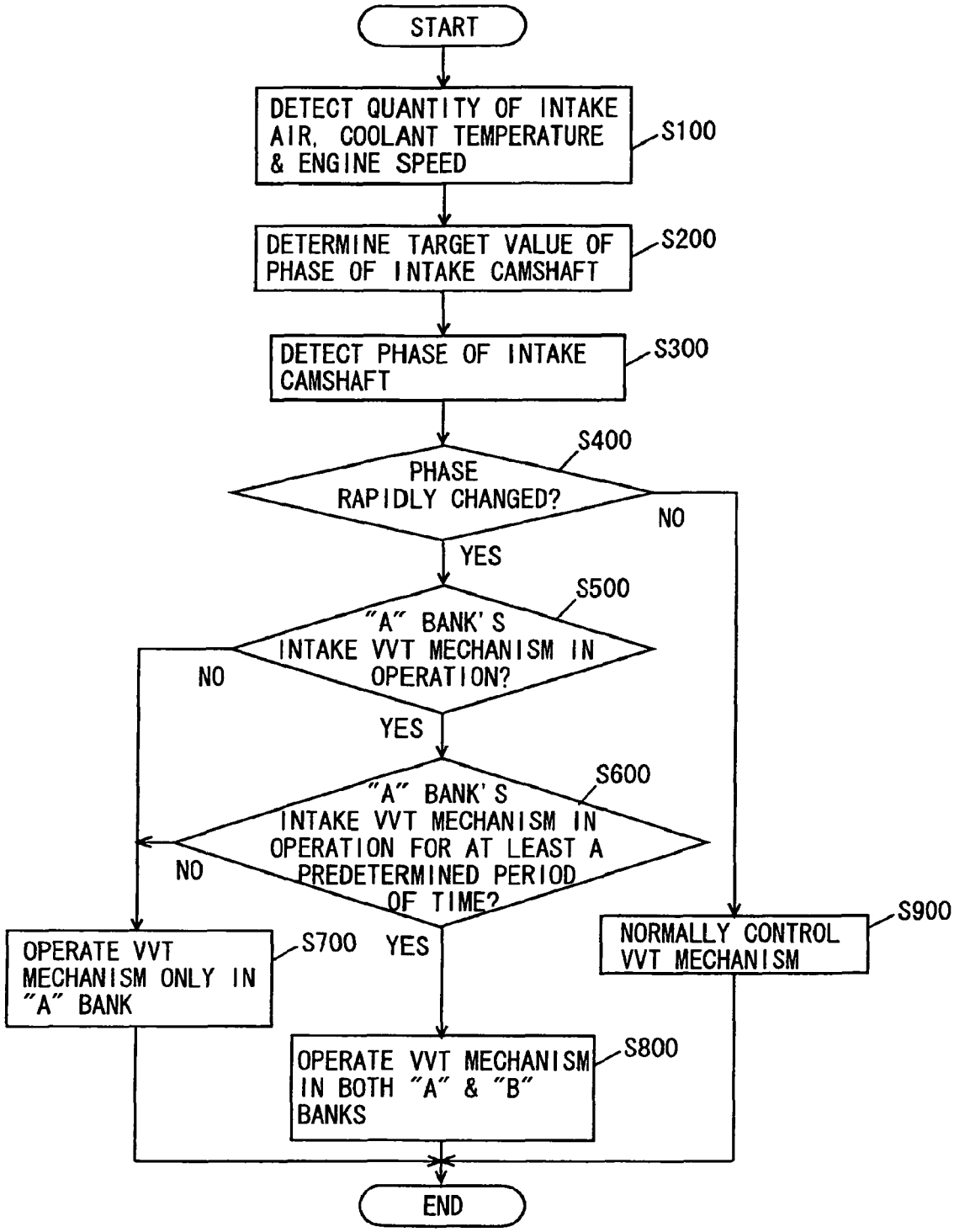
FIG. 3 is a flowchart representing a structure of a program for control executed by the ECU shown in FIG. 1.

Reference will now be made to FIG. 3 to describe a structure of a program for control executed by ECU 4000 serving as the control device of the present embodiment.

In step (S) 100 ECU 4000 detects an quantity of intake air (a load of engine 1000), a coolant temperature and an engine speed. The quantity of intake air is detected as based on a signal transmitted from air flow meter 5030. The coolant temperature is detected as based on a signal transmitted from coolant temperature sensor 5020. The engine speed is detected as based on a signal transmitted from crank position sensor 5000.

In S200 ECU 4000 determines a target value of the phase of intake camshaft 1120 as based on the map shown in FIG. 2.

In S300 ECU 4000 detects the current phase of intake camshaft 1120 as based on a signal transmitted from cam position sensor 5010.

In S400 ECU 4000 determines whether it is necessary to rapidly change the phase of intake camshaft 1120. For example, ECU 4000 so determines if the phase of the target value and the current phase have a difference larger than a predetermined value.

If it is necessary to rapidly change the phase of intake camshaft 1120 (YES in S400) the control proceeds with S500. Otherwise (NO in S400) the control proceeds with S900.

In S500 ECU 4000 determines whether intake VVT mechanism 2000 is in operation (or currently changing the phase of intake camshaft 1120) in "A" bank 1010. Intake VVT mechanism 2000 is operated as controlled by ECU 4000 itself, and whether intake VVT mechanism 2000 is in operation in "A" bank 1010 is determined internal to ECU 4000.

If intake VVT mechanism 2000 is in operation in "A" bank 1010 (YES in S500) the control proceeds with S600. Otherwise (NO in S500) the control proceeds with S700.

In S600 ECU 4000 determines whether at least a predetermined period of time has elapsed since intake VVT mechanism 2000 started to operate in "A" bank 1010. If so (YES in S600) the control proceeds with S800. Otherwise (NO in S700) the control proceeds with S700.

In S700 ECU 4000 controls intake VVT mechanism 2000 to operate only in "A" bank 1010. More specifically, ECU 4000 changes only the phase of intake camshaft 1120 of "A" bank 1010.

In S800 ECU 4000 controls intake VVT mechanism 2000 to operate in both "A" and "B" banks 1010 and 1012. More specifically, ECU 4000 changes the phase of intake camshaft 1120 in both "A" and "B" banks 1010 and 1012.

In S900 ECU 4000 normally controls intake VVT mechanism 2000 in "A" and "B" banks 1010 and 1012 so that the phase of intake camshaft 1120 attains the target value. Normally controlling intake VVT mechanism 2000, as referred to herein, indicates exerting control to operate intake VVT mechanism 2000 in both "A" and "B" banks 1010 and 1012 concurrently.

As based on the structure and flowchart as described above, ECU 4000 serving as the control device of the present embodiment operates, as will be described hereinafter.

While a vehicle is running, a quantity of intake air (or a load of engine 1000), a coolant temperature and an engine speed are detected (S100) and therefrom a target value of the phase of intake camshaft 1120 is determined (S200). Furthermore, the current phase of intake camshaft 1120 is detected (S300).

If the phase of the target value and the current phase are different (or have a difference which does not fall within a tolerable range), intake VVT mechanism 2000 needs to be controlled to match the current phase to the phase of the target value (or fall the difference between the phase of the target value and the current phase within the tolerable range).

For example if the phase of the target value and the current phase have a difference larger than a predetermined value, then opening/closing intake valve 1100 timely, as corresponding to a condition of operation of interest, would require rapidly changing the phase of intake camshaft 1120 (YES in S400).

However, rapidly changing the phase by passing a large current to two electrically operated intake VVT mechanisms 2000 simultaneously to rapidly operate the two intake VVT mechanisms 2000, can excessively increase a load of an electric circuit energizing intake VVT mechanism 2000. This can result in an insufficient current, and intake VVT mechanism 2000 can operate slow, rather than faster.

Furthermore, by a torque required to drive high pressure pump 1140, intake VVT mechanism 2000 for "A" bank 1010 is poorer in responsiveness than that for "B" bank 1012. Such a difference in responsiveness is more remarkable when an insufficient current is provided and intake VVT mechanism 2000 accordingly drives intake camshaft 1120 with an insufficient torque.

In that case, the phase attains the target value in one bank at a time and in the other bank at a further different time. Accordingly, one group (or bank) of cylinders can receive air in an amount while the other group (or bank) of cylinders can receive air in a significantly different amount, and as a result crankshaft 1090 can rotate significantly variably.

Accordingly, if it is necessary to rapidly change the phase of intake camshaft 1120 (YES in S400) and intake VVT mechanism 2000 is not in operation in "A" bank 1010 (NO in S500), intake VVT mechanism 2000 is operated only in "A" bank 1010 (S700).

Furthermore, if intake VVT mechanism 2000 is in operation in "A" bank 1010 (YES in S500), and a predetermined period of time has not elapsed since it started to operate (NO in S600), then intake VVT mechanism 2000 is operated only in "A" bank 1010 (S700).

If the predetermined period of time has elapsed since intake VVT mechanism 2000 has started to operate in "A" bank 1010 (YES in S600), intake VVT mechanism 2000 is operated in both "A" bank 1010 and "B" bank 1012 (S800).

Thus when intake VVT mechanism 2000 starts to operate, i.e., it requires current most, it is timed differently between "A" and "B" blanks 1010 and 1012 to differently start to operate (or starting to change a phase can be timed differently between the banks). This can prevent energizing intake VVT mechanisms 2000 at a time intensively. This can in turn reduce a load on an electric circuit and prevent intake VVT mechanism 2000 from receiving an insufficient current. Consequently, intake VVT mechanism 2000 can rapidly operate and intake valve 1100 can be opened/closed timely, as corresponding to a condition of operation of interest.

Furthermore, earlier operating intake VVT mechanism 2000 that is less responsive as it is associated with "A" bank 1010, can reduce variation among banks (or groups of cylinders) in when a phase attains a target value. This can reduce variation among cylinders in quantity of air and engine 1000 can rotate less variably.

Thus the present embodiment provides a control device or an ECU allowing intake VVT mechanism 2000 to operate in both "A" and "B" banks at least a predetermined period of time after intake VVT mechanism 2000 that is relatively less responsive as it is associated with "A" bank starts to operate. This can prevent energizing the intake VVT mechanisms at a time intensively and hence prevent the intake VVT mechanism from receiving an insufficient current. This allows the intake VVT mechanism to rapidly operate to open/close an intake valve timely, as corresponding to a condition of operation of interest, and can also reduce variation in when a phase attains a target value. This can reduce variation among cylinders in quantity of air, and the engine can rotate less variably.

Note that in learning a maximally retarded angle of intake camshaft 1120 intake VVT mechanism 2000 may be timed differently among cylinder groups to differently start to operate. Learning a maximally retarded angle, as referred to herein, indicates detecting the phase of intake camshaft 1120 when intake VVT mechanism 2000 is controlled to maximally retard intake camshaft 1120 immediately after engine 1000 is started or when it is stopped or the like.

Furthermore if exhaust VVT mechanism 3000 is adapted to electrically operate, exhaust VVT mechanism 3000 may be adapted to be timed differently among cylinder groups to differently start to operate.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A control device for an internal combustion engine provided with a plurality of mechanisms changing a phase in which at least one of an intake valve and an exhaust valve opens/closes, the control device comprising an operation unit controlling a first one of said plurality of mechanisms and controlling a second one of said plurality of mechanisms to start to operate later by a predetermined period of time than said first mechanism, wherein said operation unit further determines whether said phase is changed faster than predetermined, and if said phase is changed faster than predetermined, said operation unit controls said second mechanism to start to operate later by said predetermined period of time than said first mechanism.

2. The control device for an internal combustion engine according to claim 1, wherein said first mechanism is slower than another one of said plurality of mechanisms in responding to that said phase is changed.

3. The control device for an internal combustion engine according to claim 1, wherein said operation unit determines that said phase is changed faster than predetermined if said phase is changed by an amount larger than predetermined.

4. A method of controlling an internal combustion engine provided with a plurality of mechanisms changing a phase in which at least one of an intake valve and an exhaust valve opens/closes, the method comprising the steps of:

controlling a first one of said plurality of mechanisms;

controlling a second one of said plurality of mechanisms to start to operate later by a predetermined period of time than said first mechanism; and determining whether said phase is changed faster than predetermined, wherein the step of controlling said second mechanism includes the step of controlling said second mechanism to start to operate later by said predetermined period of time than said first mechanism if said phase is changed faster than predetermined.

5. The method of controlling an internal combustion engine according to claim 4, wherein said first mechanism is slower than another one of said plurality of mechanisms in responding to that said phase is changed.

6. The method of controlling an internal combustion engine according to claim 4, wherein the step of determining whether said phase is changed faster than predetermined includes the step of determining that said phase is changed faster than predetermined if said phase is changed by an amount larger than predetermined.

7. A control device for an internal combustion engine provided with a plurality of mechanisms changing a phase in which at least one of an intake valve and an exhaust valve opens/closes, the control device comprising:

first control means for controlling a first one of said plurality of mechanisms;

second control means for controlling a second one of said plurality of mechanisms to start to operate later by a predetermined period of time than said first mechanism; and determination means for determining whether said phase is changed faster than predetermined, wherein said second control means includes means for controlling said second mechanism to start to operate later by said predetermined period of time than said first mechanism if said phase is changed faster than predetermined.

8. The control device for an internal combustion engine according to claim 7, wherein said first mechanism is slower than another one of said plurality of mechanisms in responding to that said phase is changed.

9. The control device for an internal combustion engine according to claim 7, wherein said determination means includes means for determining that said phase is changed faster than predetermined if said phase is changed by an amount larger than predetermined.

* * * * *